US009165551B2

(12) United States Patent
Weiss

(10) Patent No.: US 9,165,551 B2
(45) **Date of Patent: *Oct. 20, 2015**

(54) SOUND REFLECTOR AND ELECTRONIC DEVICE WITH SPEAKER, INCLUDING SOUND REFLECTOR

(71) Applicant: Simply Amazinc LLC, Saint Paul, MN (US)

(72) Inventor: Moshe Weiss, Saint Paul, MN (US)

(73) Assignee: SIMPLY AMAZINC, LLC, Saint Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/255,461

(22) Filed: Apr. 17, 2014

(65) Prior Publication Data

US 2014/0226840 A1 Aug. 14, 2014

Related U.S. Application Data

(63) Continuation of application No. 13/962,572, filed on Aug. 8, 2013, now Pat. No. 8,731,219, which is a continuation of application No. PCT/US2012/068683, filed on Dec. 10, 2012.

(60) Provisional application No. 61/568,845, filed on Dec. 9, 2011.

(51) Int. Cl.

| | |
|---|---|
| ***H04R 1/28*** | (2006.01) |
| ***G10K 11/20*** | (2006.01) |
| ***H04R 1/00*** | (2006.01) |
| ***G10K 11/28*** | (2006.01) |
| ***H04R 1/34*** | (2006.01) |

(52) U.S. Cl.

CPC ..... *G10K 11/20* (2013.01); *G10K 11/28* (2013.01); *H04R 1/00* (2013.01); *H04R 1/34* (2013.01); *H04R 1/345* (2013.01); *H04R 2201/34* (2013.01)

(58) Field of Classification Search

CPC ..... H04R 1/2815–1/2826; H04R 1/28; H04R 1/02; H04R 1/025; H04R 1/026

USPC ..... 381/349, 352, 160, 332–343, 388

See application file for complete search history.

(56) References Cited

U.S. PATENT DOCUMENTS

| | | | | |
|---|---|---|---|---|
| 2,469,254 | A | 5/1949 | Bankson | |
| 4,967,872 | A | 11/1990 | Hart | |
| 5,778,062 | A | 7/1998 | Vanmoor | |
| 6,237,714 | B1 | 5/2001 | Lee | |
| 6,571,907 | B2 | 6/2003 | Jennings | |
| D545,812 | S | 7/2007 | Grady et al. | |
| D552,085 | S | 10/2007 | Bartley et al. | |
| 7,778,431 | B2 | 8/2010 | Feng et al. | |
| 8,256,568 | B2 * | 9/2012 | Lin | 181/179 |
| 2007/0223745 | A1 | 9/2007 | Feng et al. | |
| 2012/0241247 | A1 * | 9/2012 | Choe | 181/191 |

FOREIGN PATENT DOCUMENTS

| | | | |
|---|---|---|---|
| JP | 04152739 | A | 5/1992 |
| JP | 11308313 | A | 11/1999 |
| JP | 2005136895 | A | 5/2005 |

* cited by examiner

*Primary Examiner* — Suhan Ni

(74) *Attorney, Agent, or Firm* — Browdy and Neimark, PLLC

(57) ABSTRACT

A reflector for use with an electronic device having a loudspeaker for enhancing the sound emitted from the loudspeaker, said reflector comprising components for attaching said reflector to an edge of the electronic device, at the location of the loudspeaker, a flat portion located to be adjacent a surface of the electronic device, and a concave portion adjacent to the flat portion and presenting a concave surface to the loudspeaker.

15 Claims, 8 Drawing Sheets

SOUND REFLECTOR AND ELECTRONIC DEVICE WITH SPEAKER, INCLUDING SOUND REFLECTOR

FIELD OF INVENTION

The present invention relates a sound reflector and to the combination of an electronic device, such as, by way of nonlimiting example, the first, second, third, or fourth generation iPad®, also known as iPad®1, 2, 3, 4, etc., containing a loudspeaker in the side of its case, in combination with the sound reflector to enhance the volume and quality of the sound from the speaker.

BACKGROUND OF INVENTION

Many electronic devices, such as the iPad®, contain a loudspeaker, hereinafter "speaker", in the side of its case for providing the user with audio associated with information displayed to the viewer by the electronic device. Although sound reflectors of various types are known, no such sound reflector suitable for enhancing the sound from an electronic device speaker is known.

Table or book-sized video devices having an audio component, such as an iPad® and a Kindle®, employ a magnet in conjunction with their speakers. Magnets attract magnetic metals like iron, nickel and cobalt, and are used in computers for various purposes including hard drives, RAM and BIOS ROM. Exterior magnets adversely affect computers, but modern computers are well protected against most magnetism.

A preliminary patentability or novelty search has revealed the following potentially material prior art documents: U.S. Pat. Nos. 2,469,254; 6,237,714; 6,571,907; 7,778,431; D545,812 and D552,085.

BRIEF SUMMARY OF INVENTION

The present invention provides a novel reflector that acts to enhance sound emanating from an electronic device containing a speaker in the side, or edge, of its case.

The reflector according to the present invention achieves the improved result when coupled together of a small electronic device, such as an iPad®, a Kindle®, iPad®2, iPad®3, iPad®4, iPad® mini, iPhone®, other smart phones with embedded speakers, Nook®, BlackBerry Playbook®, Sony® tablet, Samsung® tablet, Asia EEE Pad Transformer Prime®, Toshiba® drive, AZED Iconic® tab, mobile phones, other tablets and similar devices, and more generally all mobile devices, as well as flat screen TV's having side speakers, to enhance the sound emitted from the loudspeaker of the device, the reflector comprising components for attaching the reflector to an edge of the electronic device, at the location of the loudspeaker, a flat portion located to be adjacent a surface of the electronic device, and a concave portion adjacent to the flat portion and presenting a concave surface to the loudspeaker for reflecting, or redirecting, sound from the speaker.

The coupling may be done entirely or partially mechanically, such as by legs included in the components for attaching the reflector to an edge of the electronic device, with the sound reflector located adjacent the speaker of the electronic device.

The performance of the sound reflector may be enhanced by constructing the reflector so that a substantially air-tight seal, or a seal that is made as air-tight as reasonably possible by existing technology, between at least the free end of the flat portion, or a region near the free end, and the case of the electronic device.

It is presently preferred to achieve this by providing a magnet, most preferably a strong magnet, at the free end of the flat portion of the sound reflector to achieve the desired seal when the reflector is coupled to the speaker of the electronic device, as the seal provided by the magnetic coupling has been found to enhance the sound reflection and thus the apparent amplification of sound from the speaker of the electronic device. It is also preferable that the edges of the side members of the reflector be configured to achieve a close fit with the electronic device case. Thus, it is desired to confine the sound energy, to the extent possible, within the reflector and thus guide the sound energy so that it emerges at the open end of the reflector.

The desired seal could also be achieved by making the reflector in whole or in part of a suitably resilient, flexible, e.g., rubbery, or elastomeric, material that will mate with the electronic device case to cause the free end of the flat portion, and possibly also the edges of the sides, to achieve the desired sealed relation with the case, and particularly the bottom and side edge of the case, or by providing a compressible layer or layers to achieve a comparable result.

DETAILED DESCRIPTION OF THE INVENTION

FIGS. 1-7 illustrate a preferred embodiment of a reflector 10 according to the invention. This reflector is made essentially of one piece of plastic, such as polypropylene, polyethylene, or PVC, although other plastic materials, such as polycarbonate compounds, or more resilient, flexible materials, such as rubber or silicone rubber, may be used.

Reflector 10 has an interior part that includes a flat portion 12 and an arcuate concave portion 14, located between two side members 18. Two tabs, or legs, 20 extend in a direction that is parallel to the plane of flat portion 12 and are spaced from flat portion 12 in a direction perpendicular to the plane of flat portion 12.

Figure 8:
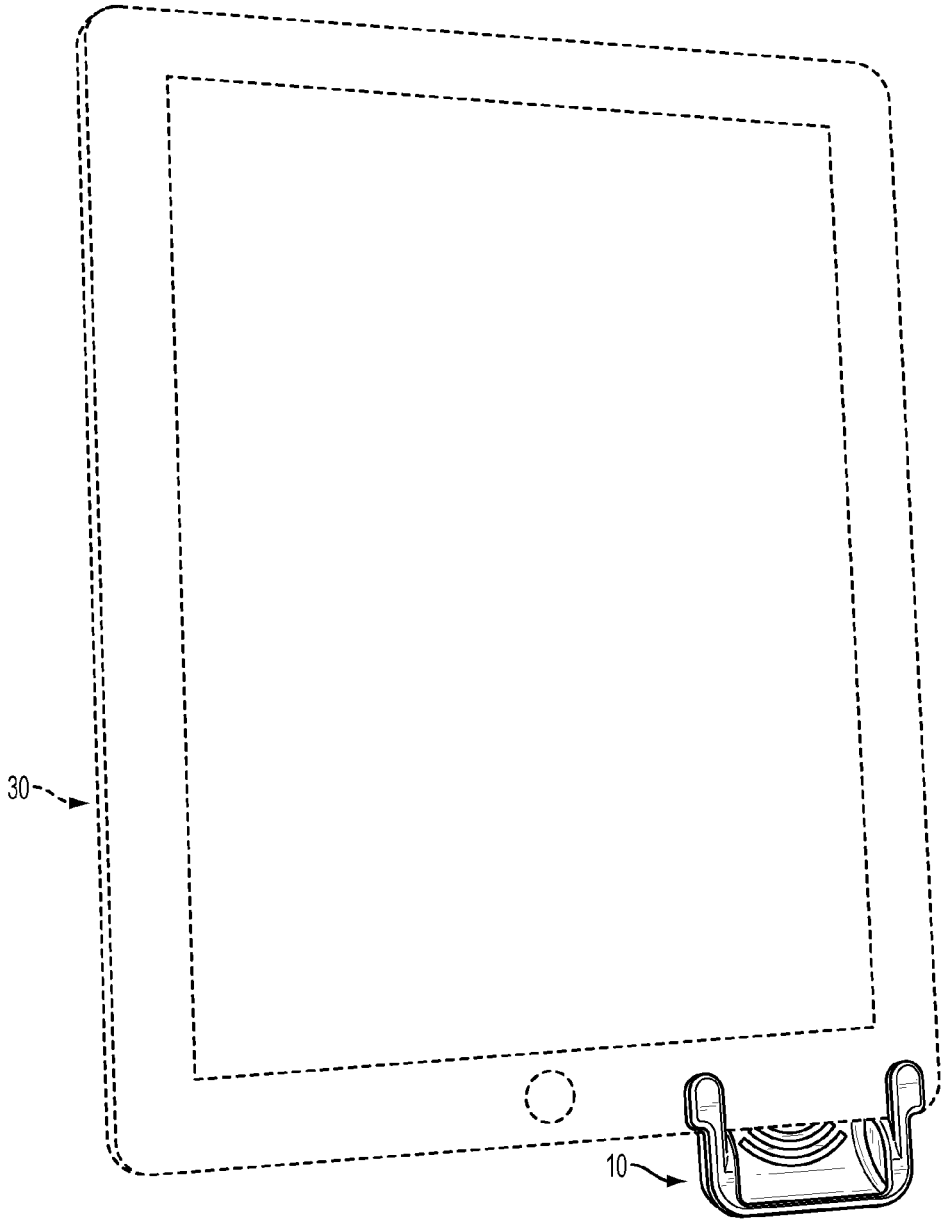
FIG. 8 is a perspective view of the sound reflector of the present invention attached to a tablet at the location of its speaker to reflect sound from the speaker to the user.

Side members 18 have concave edges 24 that cooperate with tabs 20 to create recesses 25 that allow reflector 10 to be mounted on an electronic device 30 such as an iPad 2®, as shown in FIG. 8. Side members 18 form solid walls that each extend from a respective edge 24 to bottom portion 12 and concave portion 14.

Reflector 10 will be installed at the location of the speaker, or one of the speakers, of electronic device 30 and will be held in place by gripping the edge of device 30 between edges 24 and tabs, or legs, 20. In the installed state, concave surface 14 will face toward the speaker and reflector 10 will present an open sound outlet area that is bounded by sides 18 and the free end of concave portion 14, i.e. the end of concave portion 14 that is remote from the free end of flat portion 12. Thus, reflector 10 will direct the sound produced by the electronic device toward the user, generally perpendicular to the plane of the electronic device display screen.

Figure 1:
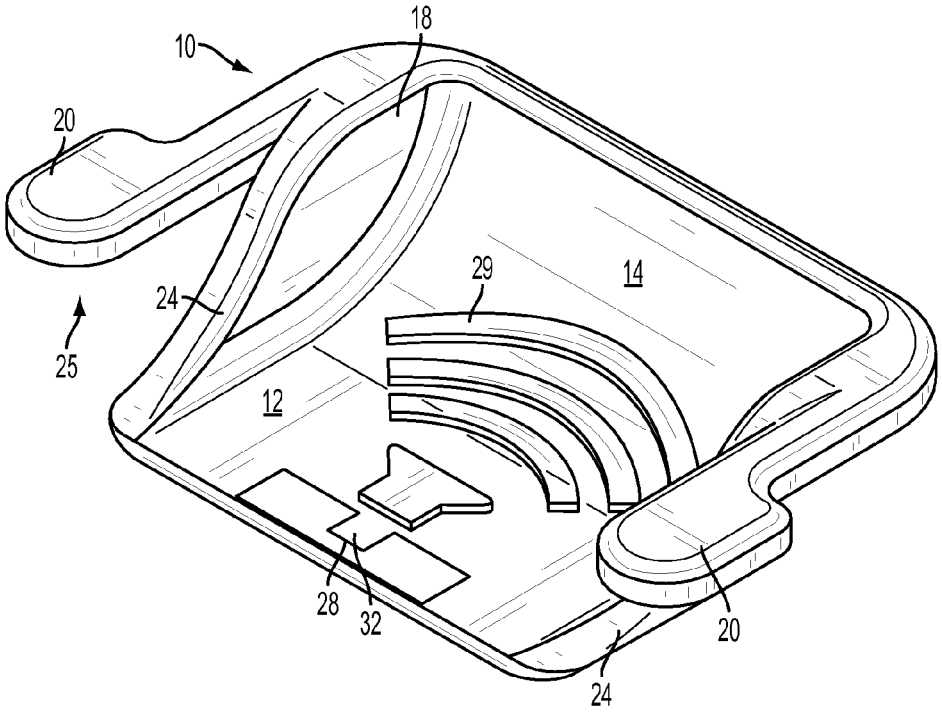
FIG. 1 is a perspective view of a sound reflector according to the present invention.
Figure 2:
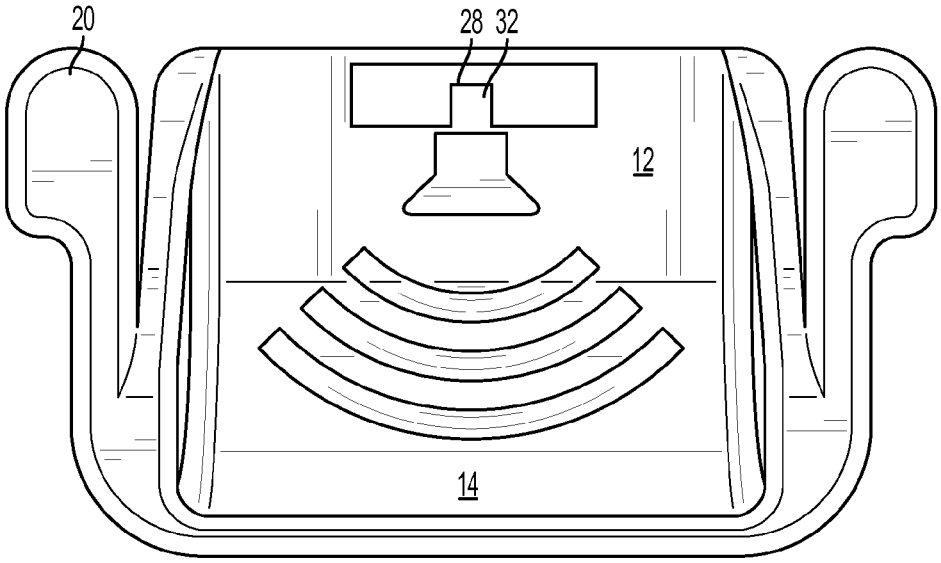
FIG. 2 is a top view thereof.
Figure 3:
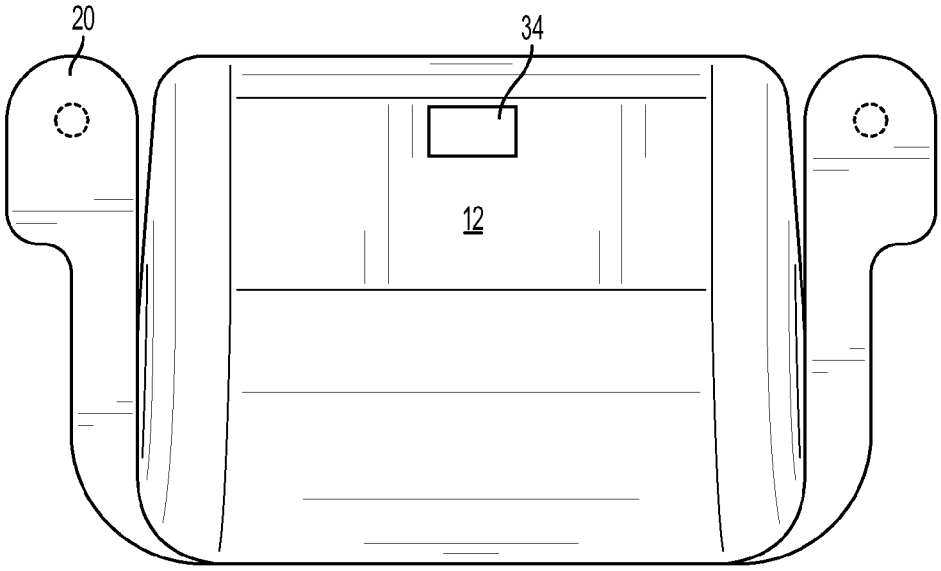
FIG. 3 is a bottom view thereof.
Figure 4:
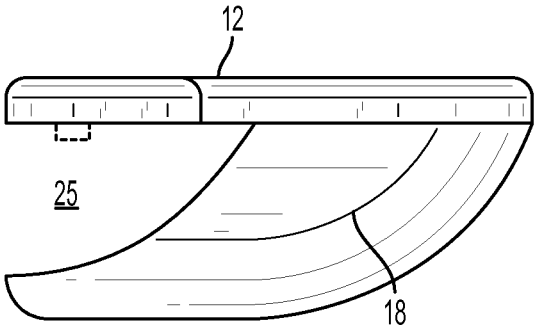
FIG. 4 is a left side view thereof.
Figure 5:
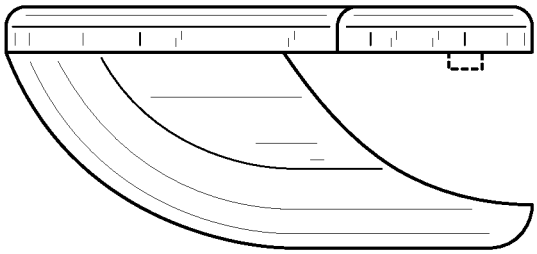
FIG. 5 is a right side view thereof.
Figure 6:
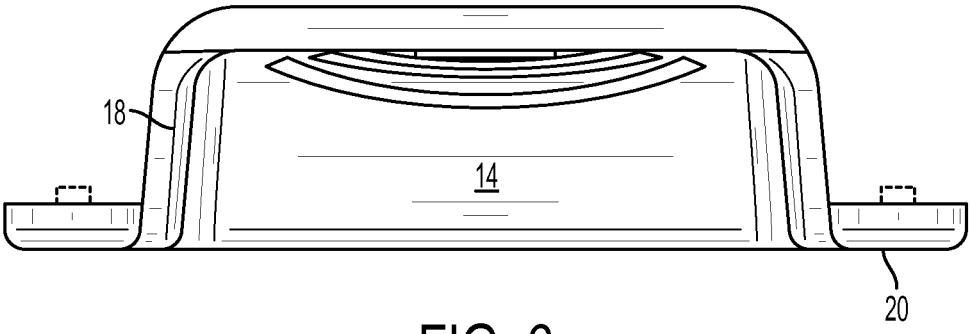
FIG. 6 is a front view thereof.
Figure 7:
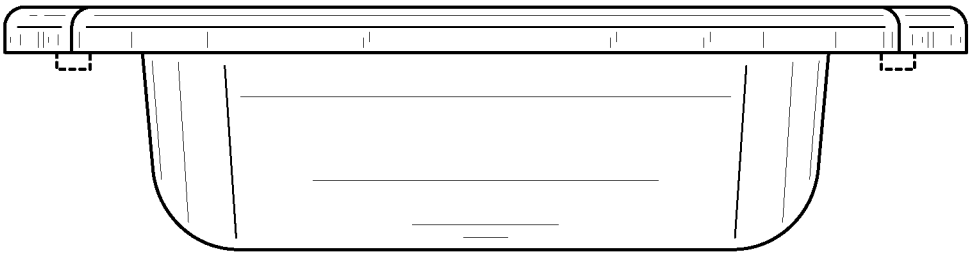
FIG. 7 is a rear view thereof.

According to a particular novel feature of the invention, reflector 20 is preferably provided with a magnet 28, shown in FIGS. 1 and 2, locate to be attracted to a magnet forming a component of, or associated with, the speaker in the electronic device. If the magnet is sufficiently strong, it may be able to hold the reflector in place on the electronic device without requiring the provision of legs 20. However, it is preferred to provide legs 20 in order to improve the integrity of the coupling between the reflector and the electronic device and to prevent the reflector from being inadvertently detached from the electronic device.

Preferably, the major surfaces of magnet 28 are parallel to the surfaces of flat portion 12 and the length dimension of magnet 28 extends between side members 18.

Preferably, magnet 28 will be made of neodymium, or a neodymium alloy or compound such as a NdFeB alloy or compound, and may, according to one exemplary embodiment, measure ¾"××¼"1/16". Other dimensions and other magnetic materials can of course be employed.

The direction of polarization of magnet 28 is, according to an exemplary embodiment, perpendicular to its major faces, i.e., parallel to its thickness dimension. However, the magnet may have a different polarization, depending on the magnetic structure in the electronic device with which the reflector is to be used.

Magnet 28 may be housed in a recess in the upper surface of flat portion 12, in retained in place by a tab 32 integral with the body of reflector 10.

Magnet 28 is located and oriented to be magnetically attracted to a magnet in the speaker of device 30 in order to provide the secure connection, and effective seal, between reflector 10 and device 30 and in particular to provide a more secure contact between flat portion 12 and the associated surface of device 30. It has been found that this helps to enhance the sound coupling between the speaker and reflector 10, with respect to both sound volume and quality.

Since the polarity of the magnet in the electronic device may be unknown, it would be desirable to be able to reverse the polarity of magnet 28. This can easily be achieved, in the embodiment shown in FIGS. 1-8, by pushing the magnet out of its recess through an opening 34 provided in the bottom of flat portion 12, which can be seen in FIG. 3, then turning the magnet over and reinstalling it in the recess.

Figure 9A:
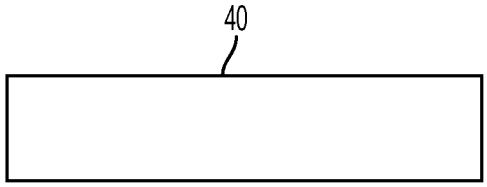
FIG. 9A is a side view of one embodiment of a magnet to be used in a reflector according to the invention.
Figure 9B:
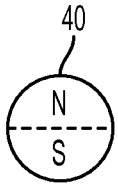
FIG. 9B is an end view of the magnet of FIG. 9A.
Figure 9C:
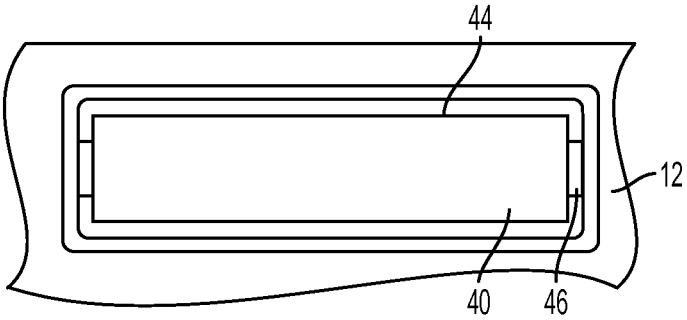
FIG. 9C is a detail plan view showing the magnet of FIGS. 9A and 9B installed in the bottom of the reflector.
Figure 10A:
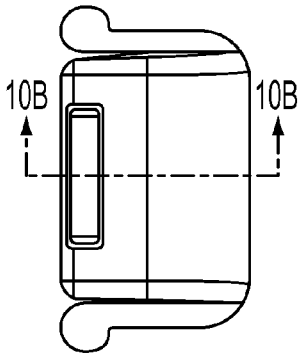
FIGS. 10A, B, C, D and E are, respectively, a bottom plan view, a side cross-sectional view, a top plan view, a top perspective view and a bottom perspective view of one alternative embodiment of the invention.
Figure 11A:
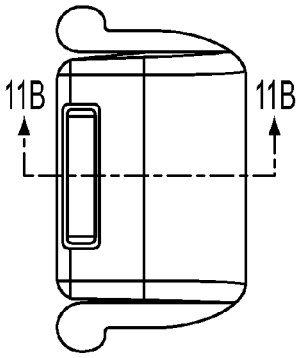
FIGS. 11A, B, C, D and E are, respectively, a bottom plan view, a side cross-sectional view, a top plan view, a top perspective view and a bottom perspective view of another alternative embodiment of the invention.
Figure 10B:
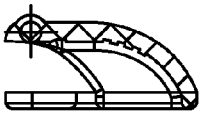
Figure 11B:
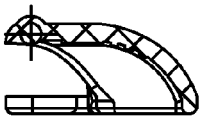
Figure 10C:
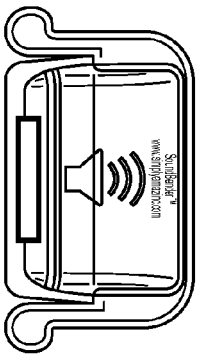
Figure 11C:
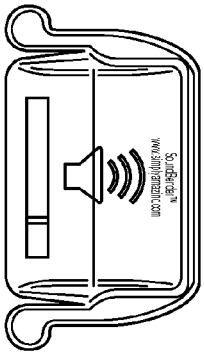
Figure 10D:
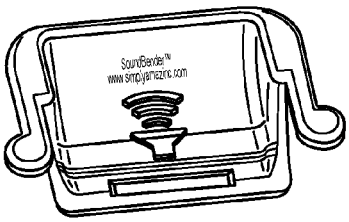
Figure 11D:
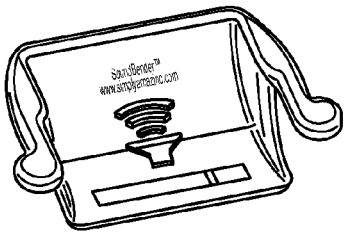
Figure 10E:
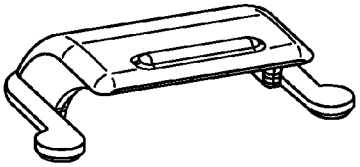
Figure 11E:
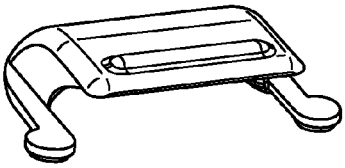
Figure 12A:
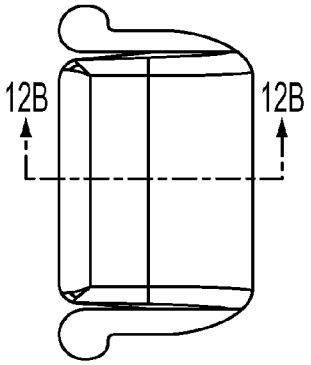
FIGS. 12A, B, C, D and E are, respectively, a bottom plan view, a side cross-sectional view, a top plan view, a top perspective view and a bottom perspective view of another alternative embodiment of the invention.
Figure 13A:
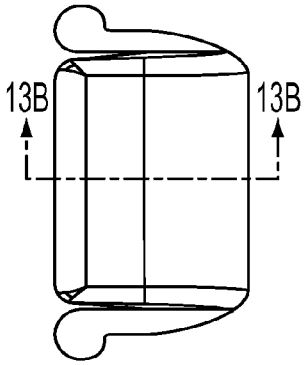
FIGS. 13A, B, C, D and E are, respectively, a bottom plan view, a side cross-sectional view, a top plan view, a top perspective view and a bottom perspective view of another alternative embodiment of the invention.
Figure 12B:
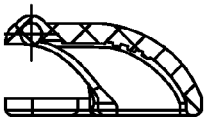
Figure 13B:
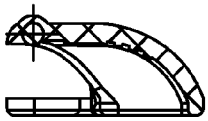
Figure 12C:
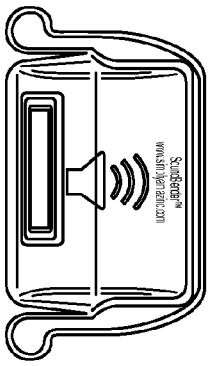
Figure 13C:
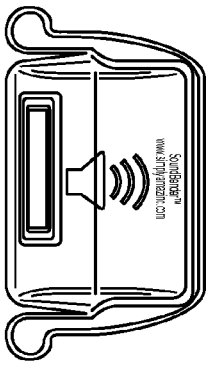
Figure 12D:
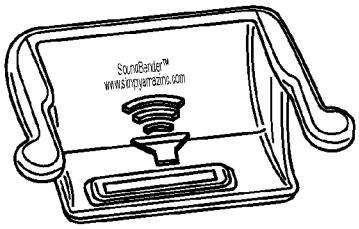
Figure 13D:
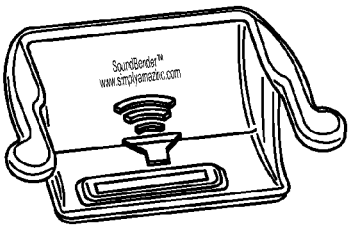
Figure 12E:
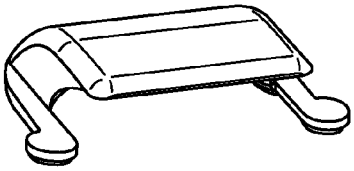
Figure 13E:
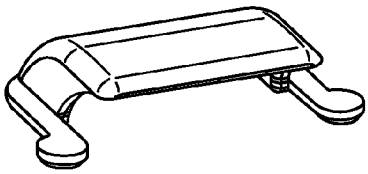

According to a further embodiment of the invention, shown in FIGS. 9A to 9C, the reflector may be provided with a cylindrical magnet 40 that is transversely polarized, as shown in FIG. 9B. Although a magnet that has a circular cross section and is diametrically polarized is shown, the magnet could also have a non-circular cross section. As shown in FIG. 9C, this magnet may be housed in a recess 44 in bottom portion 12 and retained between abutments 46 at the axial ends of magnet 40. Magnet 40 is retained in such a way as to be easily and automatically rotatable about its axis in response to the magnetic field being produced by an adjacent magnet in the speaker of an electronic device. Thus, regardless of the polarity of the latter magnet, magnet 40 will be automatically oriented to be attracted by that magnet.

As shown in the drawings, several ribs 29 may be provided on concave portion 14 on the surface facing the speaker. These ribs help to enhance the sound quality and volume improvement provided by the reflector according to the present invention.

A reflector according to the present invention may be manufactured from polycarbonate compounds that incorporate metal and/or rare-earth magnetic powder, such as Neodymium into the plastic in place of magnet 28, followed by magnetization of the powder, in order to further improve sound reflection and quality enhancement.

The reflector according to the invention does not require any electrical connection or battery power. In use, it is simply clipped onto a mobile device, as shown in FIG. 8, at the location of the speaker of that device, whereupon it immediately produces a noticeable improvement in sound volume and quality. Applicant makes no claim to actual amplification of the sound energy; however, by redirecting the sound toward the listener, the listener will hear a much louder sound and a clearer sound quality.

According to one preferred embodiment of the invention, the reflector measures 2¼" in length by 1¼" in width and ½" in height and concave portion 14 may have the form of a segment of a circular cylinder with a radius of curvature of 0.625". Of course, other dimensions and shapes may be suitable for use with various electronic devices.

FIGS. 10-13 show various alternative embodiments of the invention. For each group of figures, A shows a bottom plan view, B shows a side cross-sectional view across the section lines shown in the corresponding A view, the other side being mirror symmetrical thereto, C shows a top plan view, D shows a top perspective view, and E shows a bottom perspective view.

All of these embodiments correspond structurally to the embodiment of FIGS. 1-8, except that the embodiments of FIGS. 10-13 are provided with circularly cylindrical magnets. In FIGS. 11, the magnet has rounded axial ends provided with shallow depressions centered on the longitudinal axis of the magnet and the recess is provided with small diameter pins engaging in those depressions. In FIGS. 10C and D and 11C and D, the magnets are omitted to expose the recesses. In the embodiments of FIGS. 10 and 11, the recess for receiving the magnet forms a protrusion that projects from the bottom portion, as shown in FIGS. 10B and E and 11B and E.

Different materials may be used for the sound reflector, such as metallic, metallic thermoplastic compounds and/or magnetic thermoplastic compounds.

Different materials may affect and enhance sound reflection in different ways, such as metals, materials with magnetic or metallic properties that may create enhanced natural tones of sound when directed to one's ears.

The reflector may be provided with dimensions, including the radius of curvature of concave portion 14, specific to the electronic device for which it is designed, in order to maximize the natural tone heard when directed toward the user's ears so the most sound is reflected toward the ears to enable the user to hear the sound more clearly in relation to the specific device the reflector is being applied to.

Specific materials may be used for the magnetic sound reflector to enhance its ability to grip onto the specific electronic device it is being applied to. For example, the sound reflector may be made of rubberized (tacky) material to add grip on to the surface of the electronic device to keep the reflector from moving around and to keep the reflection pocket secured around the speaker area to reflect and redirect the most sound energy emitted from the speaker area.

The sound reflector may be provided with additional attachments to allow customized sound reflection according to the user's distance and position to the device such as an adjustable window that can be angled in the direction of the specific user's ears in order to maximize the amount of sound directed toward the specific user's ears.

The precise shape and dimensions of the sound reflector can be customized to fit to any device that has an existing speaker.

The sound reflector can also be customized to be used with any device that also incorporates a case, and or cover, since all cases and covers must have an exposed speaker area in order to allow sound to be emitted from the device.

Reflectors according to the invention can be produced in any pantone color, include customized logos, etc.

What is claimed is:

1. A reflector for enhancing the sound emitted from a loudspeaker of an electronic device, the loudspeaker being disposed at a location in the electronic device, said reflector comprising:

at least one component for attaching said reflector to an edge of the electronic device at the location of the loudspeaker;

a flat portion located to be adjacent a surface of the electronic device, side members extending transversally to said flat portion, and;

a concave portion adjacent to, and extending from, the flat portion and presenting a concave surface to the loudspeaker, wherein:

said flat portion has a free end and said reflector is constructed to cause said free end to form a seal with an outer surface of the electronic device, said side members have concave edges and wherein said free end of said flat portion and said concave edges are configured to mate with an outer surface of the electronic device.

2. The reflector of claim 1, wherein said reflector is made of a resilient flexible material having a composition selected to cause a free end of said flat portion to form a sealed coupling with the electronic device when said reflector is attached to the electronic device.

3. The reflector of claim 1, wherein said at least one component and said flat portion are constructed to cause said reflector to be held in place by said at least one component and said flat portion when said reflector is attached to the electronic device.

4. The reflector of claim 1, wherein said at least one component and said flat portion are constructed to cause said reflector to be clipped onto the electronic device when said reflector is attached to the electronic device.

5. The reflector of claim 1, wherein the seal formed by said free end of said flat portion is substantially air-tight.

6. The reflector of claim 1, wherein said concave portion of said reflector is adapted to deflect sound from the loudspeaker in a direction substantially perpendicular to the direction in which sound is emitted from the loudspeaker.

7. The reflector of claim 1, wherein said concave portion is provided with at least one rib that is adapted to enhance the quality of the sound emitted from the loudspeaker.

8. The reflector of claim 1, wherein said at least one rib comprises a plurality of ribs.

9. The reflector of claim 1, wherein said concave portion has the shape of a segment of a circular cylinder.

10. An electronic device having a loudspeaker, in combination with the reflector according to claim 1, wherein said reflector is attached to said electronic device adjacent said loudspeaker.

11. The combination of claim 10, wherein said electronic device comprises a housing enclosing said loudspeaker.

12. The electronic device of claim 10, wherein said reflector is operative to deflect sound from said loudspeaker in a direction substantially perpendicular to the direction in which sound is emitted from said loudspeaker.

13. An electronic device having a loudspeaker, in combination with the reflector according to claim 1, wherein said reflector is attached to said electronic device adjacent said loudspeaker.

14. The combination of claim 13, wherein said electronic device comprises a housing enclosing said loudspeaker.

15. The electronic device of claim 13, wherein said reflector is operative to deflect sound from said loudspeaker in a direction substantially perpendicular to the direction in which sound is emitted from said loudspeaker.

* * * * *